US006944586B1

(12) United States Patent
Harless et al.

(10) Patent No.: US 6,944,586 B1
(45) Date of Patent: Sep. 13, 2005

(54) INTERACTIVE SIMULATED DIALOGUE SYSTEM AND METHOD FOR A COMPUTER NETWORK

(75) Inventors: William G. Harless, Bethesda, MD (US); Michael G. Harless, Kensington, MD (US); Marcia A. Zier, Bethesda, MD (US)

(73) Assignee: Interactive Drama, Inc., Bethesda, MD (US)

( * ) Notice: Subject to any disclaimer, the term of this patent is extended or adjusted under 35 U.S.C. 154(b) by 0 days.

(21) Appl. No.: 09/436,725

(22) Filed: Nov. 9, 1999

(51) Int. Cl.[7] ..... G06F 17/20; G06F 9/46; G09G 5/00

(52) U.S. Cl. ..... 703/23; 704/246; 704/270.1; 704/275; 345/744

(58) Field of Search ..... 703/13, 23; 704/275, 704/270, 246; 345/744; 709/203; 706/45, 706/59, 48

(56) References Cited

U.S. PATENT DOCUMENTS

| | | | | |
|---|---|---|---|---|
| 3,392,239 | A | 7/1968 | Johnson | |
| 3,939,579 | A | 2/1976 | Andrews et al. | |
| 4,130,881 | A | 12/1978 | Haessler et al. | |
| 4,170,832 | A | 10/1979 | Zimmerman | |
| 4,305,131 | A | 12/1981 | Best | |
| 4,393,271 | A | 7/1983 | Fujinami et al. | |
| 4,445,187 | A | 4/1984 | Best | |
| 4,449,198 | A | 5/1984 | Kroon | |
| 4,459,114 | A | 7/1984 | Barwick | |
| 4,482,328 | A | 11/1984 | Ferguson | |
| 4,569,026 | A | 2/1986 | Best | |
| 4,571,640 | A | 2/1986 | Baer | |
| 4,586,905 | A | 5/1986 | Groff | |
| 4,804,328 | A | 2/1989 | Barrabee | |
| 5,006,987 | A | 4/1991 | Harless | |
| 5,219,291 | A | 6/1993 | Fong et al. | |
| 5,413,355 | A | 5/1995 | Gonzalez | |
| 5,727,950 | A * | 3/1998 | Cook et al. | 434/350 |
| 5,730,603 | A | 3/1998 | Harless et al. | |
| 5,870,755 | A * | 2/1999 | Stevens et al. | 707/104.1 |
| 5,983,190 | A * | 11/1999 | Trower et al. | 704/276 |
| 5,999,641 | A * | 12/1999 | Miller et al. | 382/154 |
| 6,065,046 | A * | 5/2000 | Feinberg et al. | 709/216 |
| 6,157,913 | A * | 12/2000 | Bernstein | 704/275 |
| 6,208,373 | B1 * | 3/2001 | Fong et al. | 348/14.16 |
| 6,253,167 | B1 * | 6/2001 | Matsuda et al. | 703/11 |
| 6,334,103 | B1 * | 12/2001 | Surace et al. | 704/257 |
| 6,347,333 | B2 * | 2/2002 | Eisendrath et al. | 709/217 |
| 6,385,584 | B1 * | 5/2002 | McAllister et al. | 704/275 |
| 6,385,647 | B1 * | 5/2002 | Willis et al. | 709/217 |
| 6,513,063 | B1 * | 1/2003 | Julia et al. | 709/219 |
| 6,604,141 | B1 * | 8/2003 | Ventura | 709/227 |
| 2002/0054088 | A1 * | 5/2002 | Tanskanen et al. | |

OTHER PUBLICATIONS http://www.compnetworks.com/benefits.htm, 1998 teach the benefits of a computer network over a stand-alone system.*

(Continued)

*Primary Examiner*—Thai Phan
(74) *Attorney, Agent, or Firm*—Finnegan Henderson Farabow Garrett & Dunner, L.L.P.

(57) ABSTRACT

An audiovisual simulation system and method facilitates simulated long distance dialogue, face-to-face, natural language, human interaction between a user and a pre-recorded human character. It does so by utilizing communications features of the Internet to survey a remote user system and establish a suitable voice recognition and digital video link, then providing that user access to specific interactive software capable of supporting a continuous virtual dialogue in natural spoken language with a pre-recorded human character stored as digital video signals.

20 Claims, 6 Drawing Sheets

OTHER PUBLICATIONS

Frantzen, V.; Huber, M.N.; Maegerl, G, "Evolutionary steps from ISDN signalling towards B-ISDN signaling,"Global Telecommunications Conference, 1992. Conference Record., GLOBECOM '92. Communication for Global Users., IEEE , 1992 □□pp.: 1161-1165 vol. 2.*

Coulouris et al., Distributed Systems Concepts and Design, Second Edition, Addison-Wesley, 1994, pp. 6-13 and 35.*

Gilmore J., Popular Electronics, vol. 13, No. 5, Nov. 1960, pp. 60-61 and 130-132.

Dickson, W. Patrick et al. "A Low-Cost Multimedia Microcomputer System for Educational Research and Development," Educational Technology (Aug. 1984), pp. 20-22.

The Use of Information Technologies for Education in Science, Math and Computers, An Agenda for Research, Educational Technology Center, Cambridge, Mass. (Mar. 1984).

Friedman, Edward A. "Machine-Mediated Instruction for Work-Force Training and Education," The Information Society (1984), vol. 2, Nos. 3/4, pp. 269-320.

Raymont, Patrick G. "Towards Fifth Generation Training Systems," Proceedings of the IFIP WG 3.4 Working Conference on The Impact of Informatics on Vocational and Continuing Educationan (May 1984).

Raymont, Patrick "Intelligent Interactive Instructional Systems," Microprocessing and Microprogramming (Dec. 1984), 14: 267-272.

Best, Robert M., "Movies That Talk Back," IEEE Transactions on Consumer Electronics, vol. CE-26, Aug. 1980.

Dickson, W. Patrick, "Experimental Software Project: Final Report," Wisconsin Center for Educational Research, University of Wisconsin, Jul. 1986.

* cited by examiner

610

STATE "15" (topic = "SELECT A QUESTION FROM THESE THREE...")

(

WORD "What type of work do you do?" (num = 2, order= 1);//Seg 6

WORD "What brings you here?" (num = 5, order= 2);//Seg 2

WORD "Are you married?" (num = 3, order= 3);//Seg 11

620

Figure 6

Interrupt Table 630 635

| | | | | | | | | | | Seg# | Question |
|---|---|---|---|---|---|---|---|---|---|---|---|
| 40 | 15 | 01 | 02 | -01 | -01 | 001 | -001 | -001 | -001 | 0006 | What type of work do you do |
| 40 | 15 | 01 | 04 | -01 | -01 | 001 | -001 | -001 | -001 | 0035 | Do you have any medical problems |
| 40 | 15 | 01 | 05 | -01 | -01 | 001 | -001 | -001 | -001 | 0002 | What brings you here? |
| 40 | 15 | 01 | 07 | -01 | -01 | 001 | -001 | -001 | -001 | 0053 | How long have you had a weight problem |
| 40 | 15 | 01 | 03 | -01 | -01 | 001 | -001 | -001 | -001 | 0011 | Are you married |
| 40 | 18 | 01 | 03 | -01 | -01 | 004 | -001 | -001 | -001 | 0819 | Let's talk more about your marriage |
| 40 | 18 | 01 | 04 | -01 | -01 | 001 | -001 | -001 | -001 | 0038 | What have you tried |
| 40 | 18 | 01 | 05 | -01 | -01 | 001 | -001 | -001 | -001 | 0028 | Tell me about your family |

640

Segment Table

645

| | Seg# | | Type | | | | In | Out | | | | | Cont | | | State | NextSeg | Description |
|---|---|---|---|---|---|---|---|---|---|---|---|---|---|---|---|---|---|---|
| 54 | 0001 | 00 | 1 | 01 | 1 | 03 | 01633 | 02390 | 01 | 1 | 0 | 00 | 0 | 4 | 01 | 17 | 0779 | Begin/Pat at Potomac |
| 54 | 0002 | 00 | 1 | 01 | 1 | 03 | 03537 | 03832 | 03 | 1 | 0 | 00 | 1 | 4 | 01 | 15 | 0000 | "I want a gastroplasty |
| 54 | 0003 | 00 | 1 | 01 | 1 | 03 | 04568 | 04675 | 03 | 1 | 0 | 00 | 1 | 4 | 01 | 26 | 0000 | "I have to do something! |
| 54 | 0004 | 00 | 1 | 01 | 1 | 03 | 04676 | 05622 | 03 | 1 | 0 | 00 | 3 | 4 | 00 | 00 | 0000 | "My sister died |
| 54 | 0005 | 00 | 1 | 01 | 1 | 03 | 19192 | 19288 | 03 | 1 | 0 | 00 | 2 | 4 | 00 | 00 | 0000 | "I like chocolate |
| 54 | 0006 | 00 | 1 | 01 | 1 | 03 | 03834 | 04567 | 03 | 1 | 0 | 00 | 1 | 4 | 07 | 06 | 0000 | "I'm an Assoc Prof of Anthro |
| 54 | 0007 | 00 | 1 | 01 | 1 | 03 | 13882 | 14239 | 03 | 1 | 0 | 00 | 1 | 4 | 00 | 00 | 0000 | "Let's get on with it! |
| 54 | 0008 | 00 | 1 | 01 | 1 | 03 | 05696 | 05792 | 03 | 1 | 0 | 00 | 2 | 4 | 01 | 24 | 0000 | "I'm 48 years old |
| 54 | 0009 | 00 | 1 | 01 | 1 | 03 | 05794 | 06108 | 03 | 1 | 0 | 00 | 1 | 4 | 01 | 18 | 0000 | "Why won't you let me? |
| 54 | 0010 | 00 | 1 | 01 | 1 | 03 | 06112 | 06318 | 03 | 1 | 0 | 00 | 1 | 4 | 01 | 18 | 0000 | "I like my work |
| 54 | 0011 | 00 | 1 | 01 | 1 | 03 | 06438 | 06573 | 03 | 1 | 0 | 00 | 2 | 4 | 01 | 19 | 0000 | "I've been married 17 yrs |

INTERACTIVE SIMULATED DIALOGUE SYSTEM AND METHOD FOR A COMPUTER NETWORK

BACKGROUND OF THE INVENTION

The present invention relates generally to an interactive simulated dialogue system and method for simulating a dialogue between persons. More particularly, the present invention relates to an audiovisual simulated dialogue system and method for providing a simulated dialogue over a computer network. Currently, a simulated dialogue program combines digital video and voice recognition technology to allow a user to speak naturally and conduct a virtual interview with images of a human character. These programs facilitate, for example, professional education through direct virtual dialogue with acknowledged experts; patient education through direct virtual dialogue with health professionals and experienced peers; and foreign language training through virtual interviews with native speakers.

Simulated dialogue programs have been developed in accordance with the methods and apparatus disclosed by Harless, U.S. Pat. No. 5,006,987. One such program is a virtual interview with Dr. Jackie Johnson, a female oncologist, which allows women concerned about breast cancer to obtain in-depth information from this acknowledged expert. Another simulated dialogue program allows users to learn about the issues and concerns of biological warfare from Dr. Joshua Lederberg, a Nobel laureate. Still another program allows students of the Arabic language to conduct virtual interviews with Iraqi native speakers to learn conversational Arabic and sustain their proficiency with that language.

These programs, however, are implemented in a standalone computer environment. As such, each user must not only have the necessary hardware, they also need to install the necessary software. Moreover, the users must choose and select the desired simulation topics to be loaded on the computer as well as supplement them on an ongoing basis. Thus, it is desirable to provide realistic simulated dialogues over a computer network.

SUMMARY OF THE INVENTION

Accordingly, the present invention is directed to an interactive simulated dialogue system that substantially obviates one or more of the problems due to limitations and disadvantages of the related art.

In accordance with the purposes of the present invention, as embodied and broadly described, the invention provides a system for an interactive simulated dialogue over a network including a client node connected to the network including a browser for selecting a simulated dialogue program, a network connection for receiving over the network a vocabulary set corresponding to the selected simulation program, a client agent transmitting over the network signals corresponding to a user voice input, a client buffer agent receiving over the network signals representative of a meaningful response to the user voice input, and an output component for outputting an audiovisual representation of a human being speaking the meaningful response. The system further includes a server coupled to the network including a database containing vocabulary sets, wherein each vocabulary set corresponds to a simulated dialogue program, a server launch agent receiving over the network the selected simulated dialogue program and transmitting over the network the vocabulary set corresponding to the selected simulated dialogue program, a server agent for receiving signals over the network corresponding to the user voice input and for determining a meaningful response to the user voice input, and a server buffer agent for transmitting over the network signals representative of the meaningful response.

In another embodiment, the invention provides a method for an interactive simulated dialogue over a computer network including a client node and a server. The method performed by the client node includes determining a system capacity of the client node, receiving a simulated dialogue program from the server, installing the simulated dialogue program based on the determination of the system capacity, receiving user voice input, transmitting to the server signals corresponding to the user voice input, receiving from the server signals representative of a meaningful response to the user voice input, and outputting an audiovisual representation of a human being speaking the meaningful response.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of this specification, illustrate one embodiment of the invention and together with the description, serve to explain the principles of the invention.

In the drawings,

FIG. 6 shows a relationship between an interrupt table and a segment table.

DESCRIPTION OF THE PREFERRED EMBODIMENT

Reference will now be made in detail to the preferred embodiment of the present invention, an example of which is illustrated in the accompanying drawings.

Figure 1:
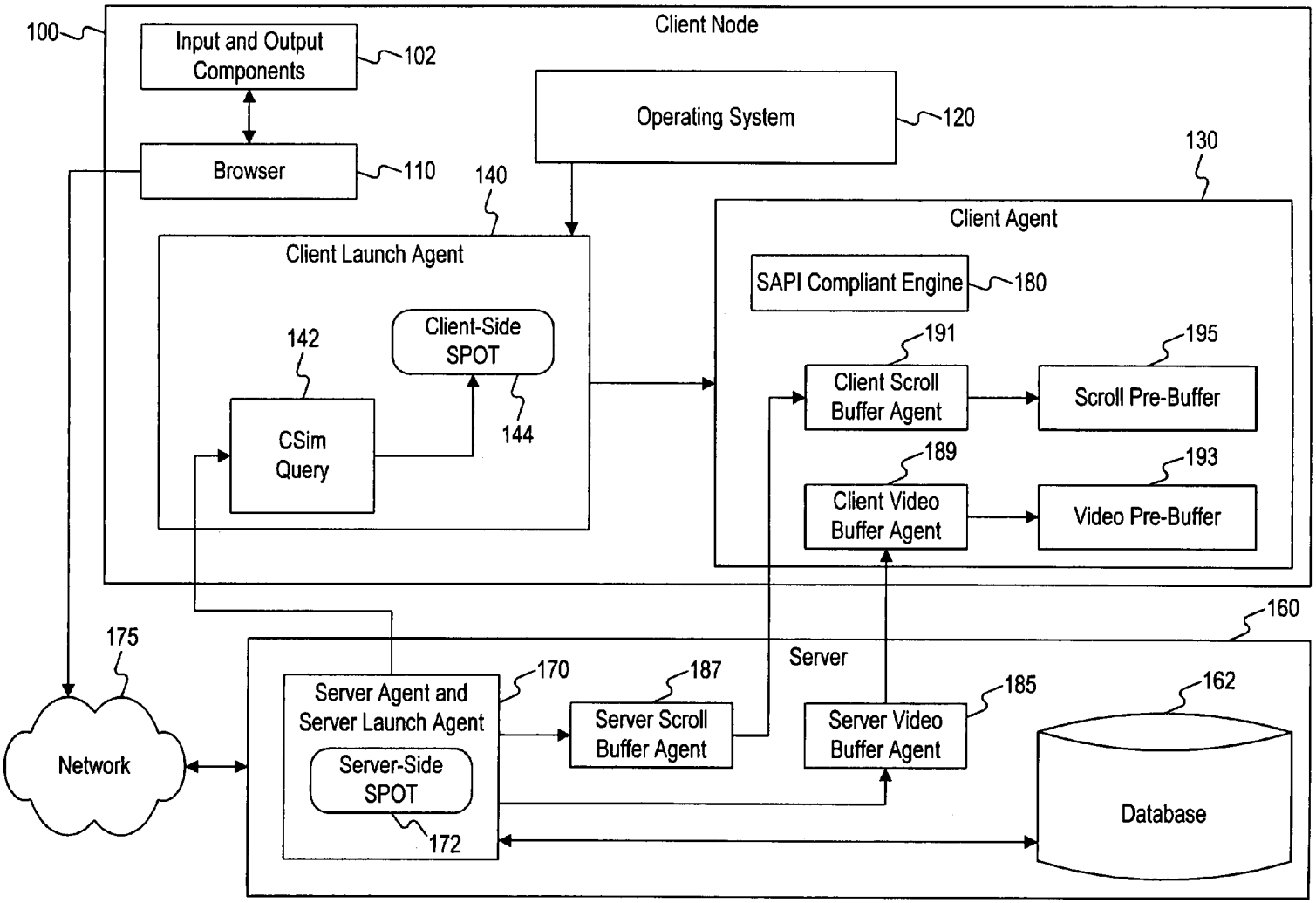
FIG. 1 is a schematic diagram of an interactive simulated dialogue system over a computer network according to one embodiment of the present invention.

FIG. 1 is a schematic diagram of a network for an interactive simulated dialogue consistent with one embodiment of the present invention. In general, the network includes a client node 100 having a browser 110, an operating system 120, a client agent 130, and a client launch agent 140. The network further includes a server 160 and a server agent/launch agent 170. Client node 100 connects to server 160 over a computer network 175 such as the Internet. Although the connection may be over any type of computer network, the computer network will hereinafter be referred to as the Internet for explanatory purposes.

Client node 100 is preferably an IBM-compatible personal computer with a Pentium-class processor, memory, and hard drive, preferably running Microsoft Windows. Generally, client node 100 also includes input and output components 102. Input components may include, for example, a mouse, keyboard, microphone, floppy disk drives, CD ROM and DVD drives. Output components may include, for example, a monitor, a sound card, and speakers. The monitor is preferably an XGA monitor with 1024×768 resolution and 16 bit color depth. The sound card may be a Sound Blaster or a comparable sound card. The number of client nodes is limited only by client license(s), available bandwidth, and hardware capability. For a detailed description of exemplary hardware components and implementation of client node 100, see U.S. Pat. Nos. 5,006,987 and 5,730,603, to Harless.

Client agent 130 is a program that enables a user to ask a question in spoken, natural language and receive a meaningful response from a video character. The meaningful response is, for example, video and audio of the video character responding to the user's question. Client agent 130 preferably includes speech recognition software 180. Speech recognition software 180 is preferably one that is capable of processing a user's voice input. This eliminates the need to "train" the voice recognition software. An appropriate choice is Dragon Systems' VoiceTools. Client agent 130 may also enable "intelligent prompting" as described below.

Operating system 120 connects to client launch agent 140 to oversee the checking and installation of necessary software and tools to enable client node 100 to run interactive simulated dialogues. While the process of checking and installing may be implemented at various stages, it is preferably performed for a first-time user during registration. Initially, a user at client node 100 may connect to server 160 via the Internet. The user then selects a case from a plurality of choices on server 160 through browser 110. Browser 110 sends the case-specific request to server launch agent 170. For first-time users, server launch agent 170 downloads and runs Csim Query 142 (explained in more detail in connection with FIG. 2).

Server 160 accesses database 162, which may be located at server 160 or a different location. Database 162 contains a vocabulary of questions or statements that may be understood by a virtual character in the selected case, and command words that allow the user to navigate through the program and review the session.

Database 162 also stores the plurality of interactive simulation scenarios. The interactive simulation scenarios are stored as a series of image frames on a media delivery device, preferably a CD ROM drive or a DVD drive. Each frame on the media delivery device is addressable and is accessible preferably in a maximum search time of 1.5 seconds. The video images may be compressed in a digital format, preferably using Intel's INDEO CODEC (compression/decompression software) and stored on the media delivery device. Software located on the client node decompresses the video images for presentation so that no additional video boards are required beyond those in a standard multimedia configuration.

Database 162 preferably contains two groups of image frames. The first group relates to images of a story and characters involved in the simulated drama. The second group contains images providing a visual and textual knowledge base associated with the simulated topic, known as "intelligent prompts." Intelligent prompts may be used to also display scrolling questions, preferably three, that are dynamically selected for their relevance to the most recent response of the virtual character.

Server 160 further includes a server buffer agent, preferably video buffer agent 185 and scroll buffer agent 187. Client node 100 further includes a client buffer agent, preferably scroll buffer agent 191, video buffer agent 189, scroll pre-buffer 193, and video pre-buffer 195. These components are described in more detail below with reference to FIG. 3.

Figure 2:
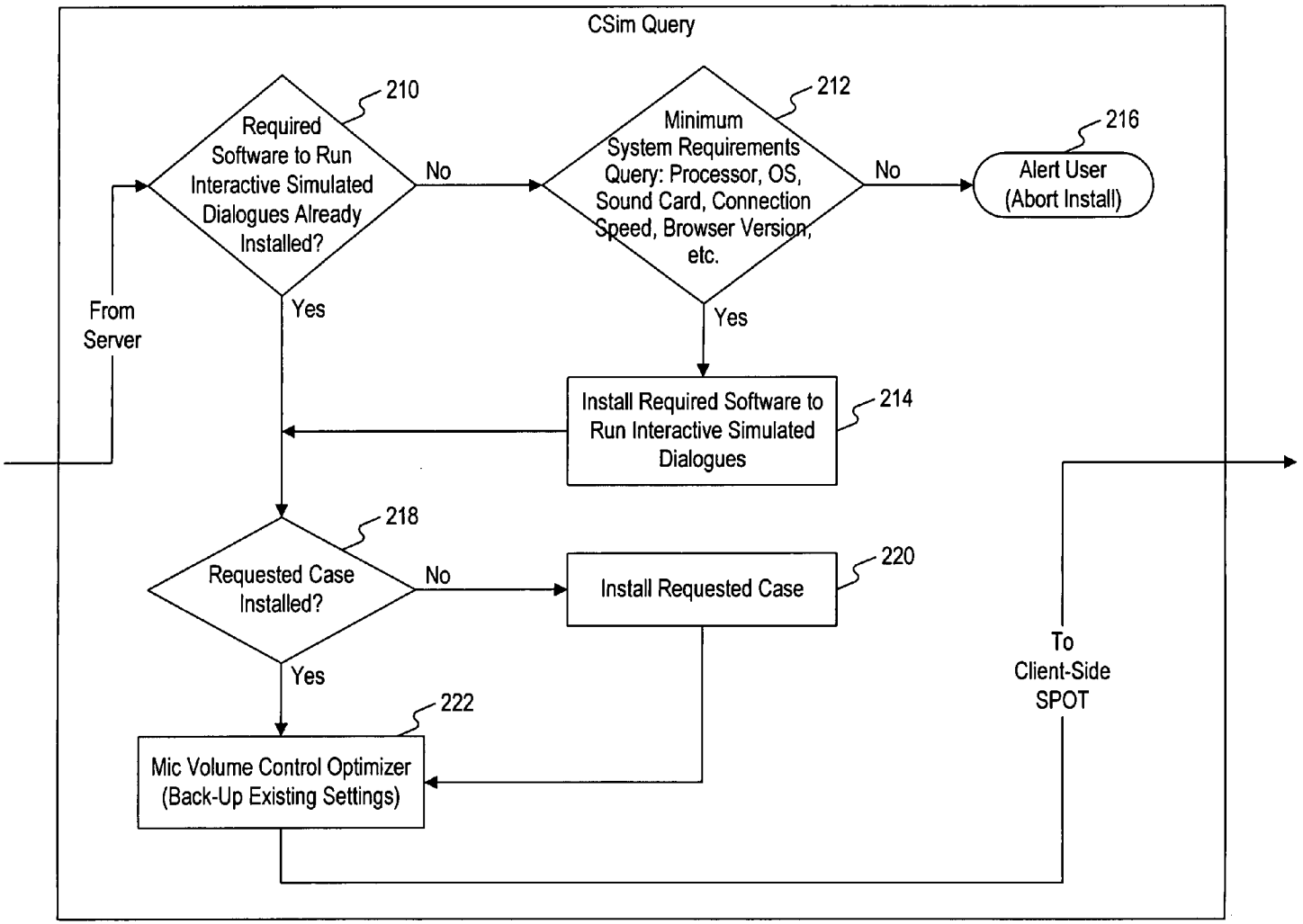
FIG. 2 is a schematic diagram illustrating in detail the query process shown in FIG. 1.

FIG. 2 illustrates Csim Query 142. Csim Query 142 checks and installs the necessary software and tools to enable client node 100 to run interactive simulated dialogues. In step 210, server 160 interacts with client launch agent 140 using SPOT (SPeech On The web) 172 to determine whether a SAPI (Speech Applications Programmers Interface) compliant speech recognition engine, such as ViaVoice or Dragon Naturally Speaking™ resides on client node 100. SPOT 172 is a commercial software program developed by Speech Solutions, Inc. If client node 100 does not have a SAPI compliant engine, client launch agent 140 determines if client node 100 has the minimum requirements to run the necessary software in step 212. If client node 100 has the minimum requirements to run the necessary software, client agent 140 downloads and installs the necessary software once permission is received in step 214. If client node 100 does not meet the minimum system requirements to run the software, the user is alerted and the install process is aborted in step 216.

If client launch agent 140 determines a SAPI compliant speech recognition engine resides on the system, client launch agent 140 then determines the identity and nature (version, level of performance, functionality) of the engine. If the engine has the recognition power (corpus size, independent speaker, continuous speech capabilities) and functionality (word spotting, vocabulary enhancement and customization), it is used by the interactive simulated dialogue program. If the resident engine does not have the recognition power and functionality to run the interactive simulated dialogue, client agent 140 downloads the necessary software once permission is received.

Once the necessary speech recognition software is installed on the user's system, client launch agent 140 determines if the case requested by the user is already on client node 100 as shown in step 218. If not, the files for the requested scenario are installed in step 220 on client node 100.

In step 222, client node 100 is optimized for user voice commands entered by, for example, a microphone. A Mic Volume Control Optimizer queries the client's operating system to determine its sound card specification, capabilities, and current volume control settings. Based on these finding, the optimizer adjusts the client system for voice commands. In a client node running Microsoft Windows, for example, the optimizer will create a backup of the current volume control settings in a temp directory and interface with the playback controls of the Windows volume control utility to deselect/mute the volume of the microphone playback through the client's speakers. The Mic Volume Control Optimizer also interfaces with a recording control of the Windows volume control utility to select and adjust the microphone input volume, and interfaces with the advanced controls of the microphone of the Windows volume control to enable the Mic gain input boost.

Figure 3:
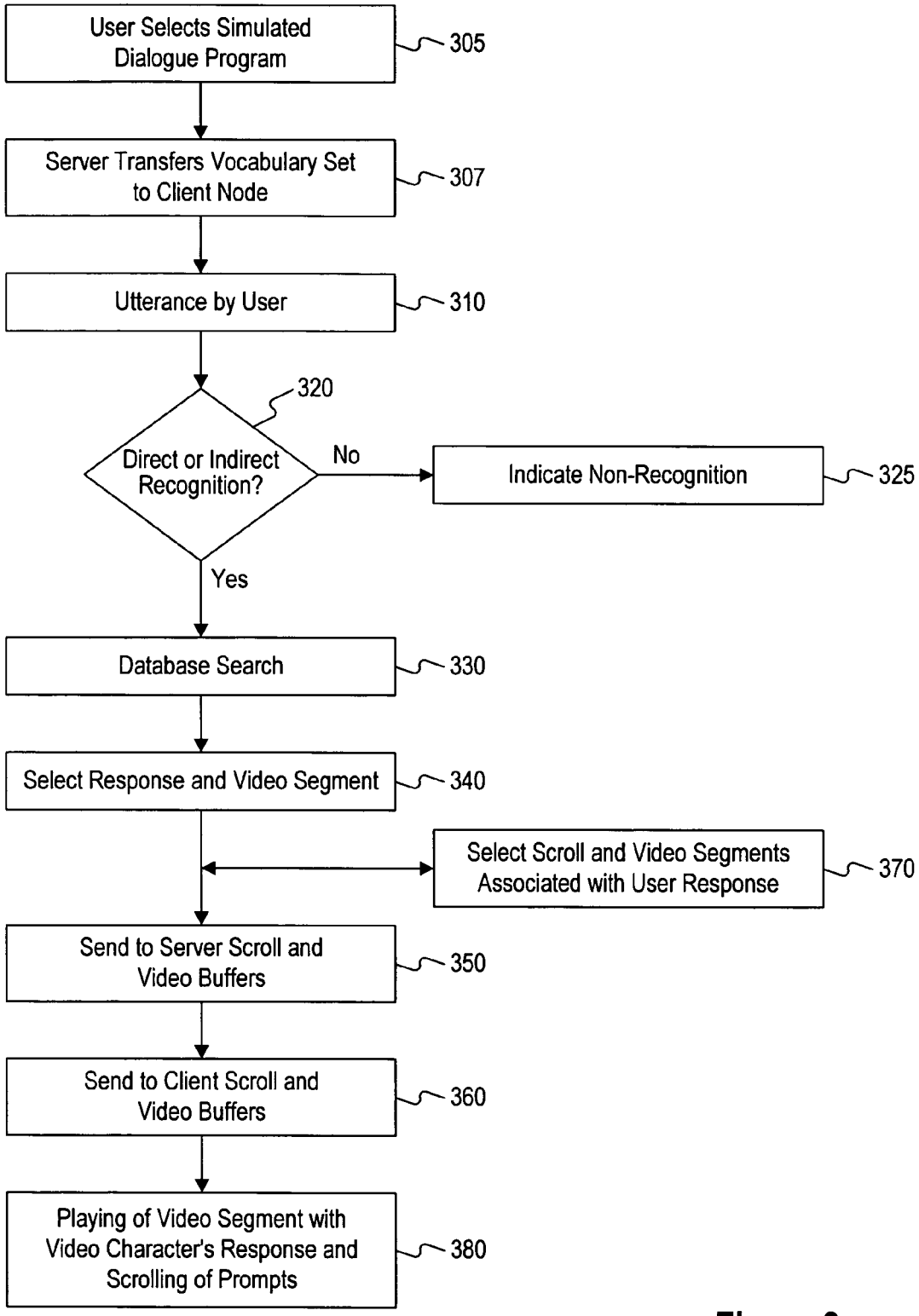
FIG. 3 is a general flow diagram of the interactive simulation.

FIG. 3 is a general flow diagram of the interactive simulation consistent with one embodiment of the invention. A user, in step 305, selects a simulated dialogue program, or case. The user then connects to an Internet site and selects a simulated dialogue program by clicking with a mouse on an icon representing the desired program. As shown in step 307, the server than transmits to the client node a vocabulary set corresponding to the selected interactive simulation program.

The selected interactive simulation program allows the user to assume the role of, for example, a doctor diagnosing a patient. Using spoken inquires and commands, the program allows the user to interview the patient/video character generated from images from database 162 and direct the course of action.

The simulated dialogue begins with an utterance or voice input by the user. As shown in step 310, the voice input is digitized and analyzed by the SAPI compliant speech recognition engine. The voice input may be prompted by comments, statements, or questions that scroll on the video display. The client agent, using the recognition engine (described in further detail below with reference to FIG. 4), then determines whether there is direct, indirect, or non-recognition of the utterance in step 320. Recognition of the voice input results in an interrupt number being sent by the client agent to the server agent (described in further detail with reference to FIG. 5). Server agent, in step 330, searches the internal database for a meaningful response for the video character. When a response is selected, its associated video segment consisting of image frames and audio signals representing human speech is retrieved and sent by the server video buffer agent to a client video buffer agent as shown in step 350. Prompts associated with the selected response are transmitted by the server scroll buffer agent to a client scroll buffer agent. In a preferred embodiment, three prompts are associated with a selected response. The prompts and video segments received by the client scroll and buffer agents are stored in a pre-buffer as shown in step 360. Using the monitor and speakers, client node 100 then plays the video and audio, and scrolls the prompts as shown in step 380. Upon seeing and hearing the meaningful response to the user's question, the user continues the interactive simulated dialogue by entering another voice input based on the scrolling prompts.

In anticipation of the user's response of uttering another question based on the scrolling prompts, video segments and prompts associated with a meaningful response to the prompts are also downloaded from the server and buffered in the client system as shown in step 370. This minimizes response times to sustain the illusion of a continuous conversation with the character.

Figure 4:
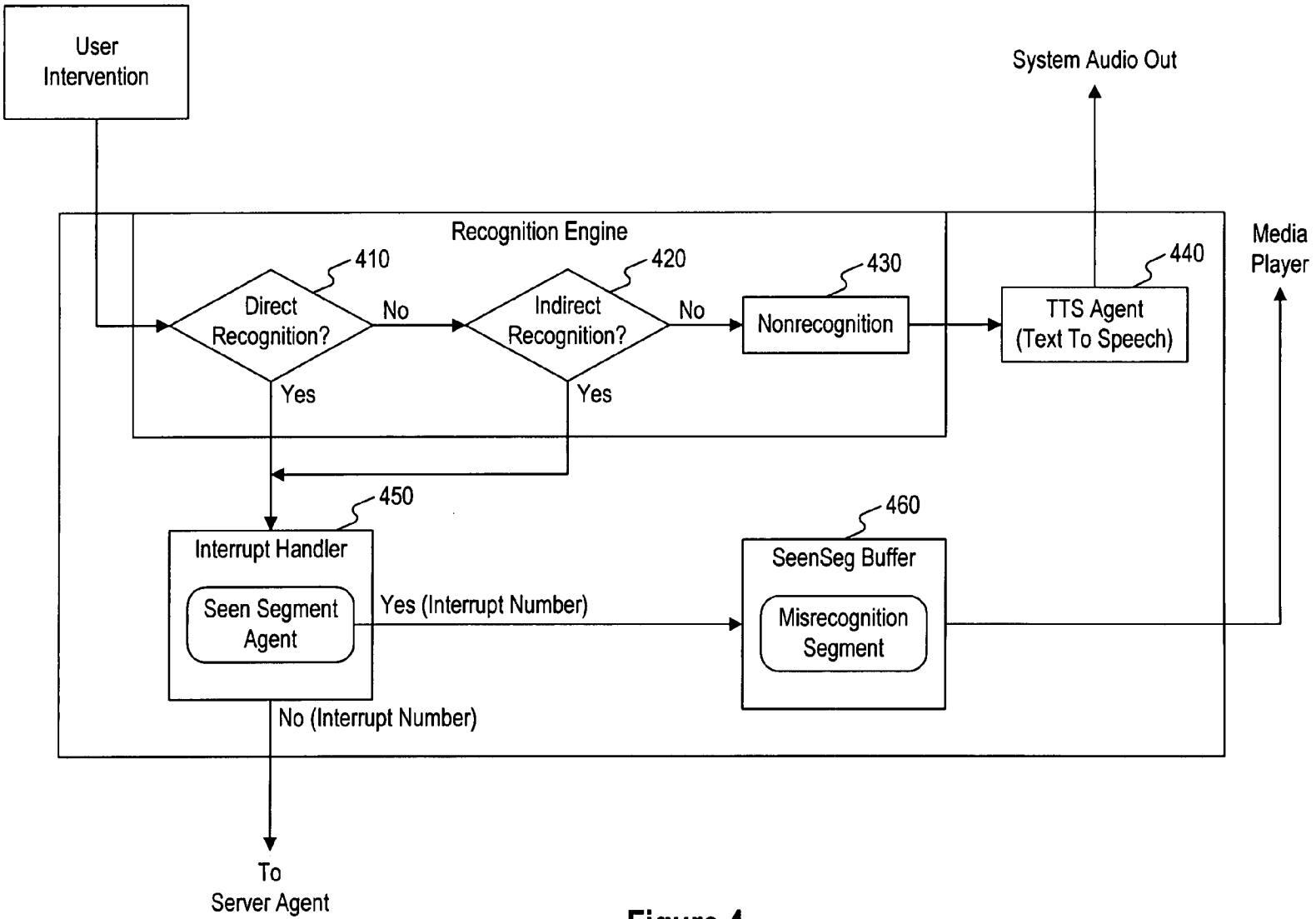
FIG. 4 is a detailed flow diagram of the client node.

FIG. 4 illustrates the recognition engine of the client agent. A direct recognition 410 is almost always the result of the user selecting and uttering a phrase from the dynamic intelligent prompting system that scrolls the words and phrases from a precise vocabulary. These prompts help to guide a user unfamiliar with the system. If there is no direct recognition of the utterance, a second analysis ensues, using the logic and corpus of the resident recognition engine to determine what the user said. A second analysis is almost always required when the user utters a free speech inquiry that is either a paraphrase of a prompt or a spontaneous question or a statement that may or may not be answerable by the simulation character. In this second analysis, the text of the utterance is compared to a key word list of the instant scenario. If the comparison yields a match, the result is an indirect recognition 420. If the comparison does not yield a match 430, the text of the utterance is transmitted through the Internet interface to the server agent with a parameter indicating that the utterance could not be understood 440. A direct or indirect recognition results in an interrupt number being sent through the Internet interface to server agent 330 explained in further detail with respect to FIG. 5.

In order to avoid displaying redundant prompts that will trigger redundant scenes, interrupt handler 450 maintains a list of previously displayed scene segments. In the event an utterance is mis-recognized as redundant, mis-recognition segment buffer 460 buffers video segments that inform the user that an utterance was not recognized.

Figure 5:
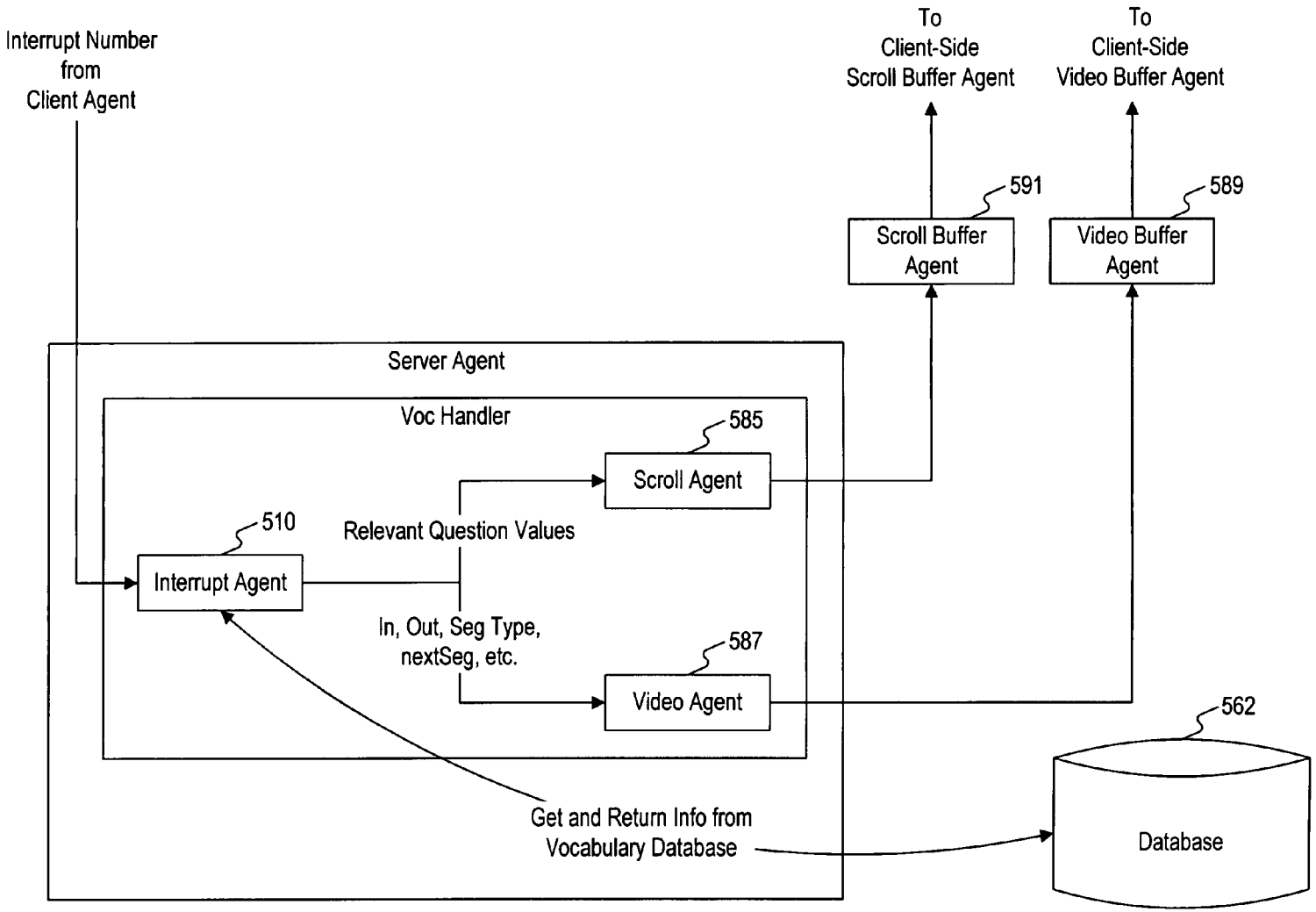
FIG. 5 is a detailed flow diagram of the server.

FIG. 5 illustrates in further detail the step of receiving an interrupt number by the server agent (step 330 of FIG. 3). Reception of an interrupt number by interrupt agent 510 initiates a search of database 562 for a meaningful response from the video character. When a response is selected, the response and its associated prompts are transmitted to scroll buffer agent 587. The associated video segment are also retrieved and transmitted it to the video buffer agent 585. As previously discussed, video buffer agent 587 also retrieves video segments associated with subsequent responses to the transmitted prompts. In one embodiment, video buffer agent 587 determines the network capacity for the transfer of the video segments. Network capacity depends on many factors including available bandwidth and network connection speed. Based on this determination, video agent 587 transfers portions of the video segments of each of the subsequent responses on a rotational basis. Since video agent 587 rotates only the relevant segments to the most recent response into the buffer, download time is minimized and bandwidth saved.

FIG. 6 illustrates in further detail the step of selecting an interrupt number in response to the user's utterance (step 330 of FIG. 3). In each interactive simulation, a potential topic of conversation is assigned a state 610. There is no limit to the number of states that can exist for a given interactive simulation. State 610, for example, relates to medical history. Within each state are suggested questions 620 that prompt the user to elicit a response from the video character. If a user utters a prompted phrase that is recognized by the recognition engine, an interrupt number is transmitted to the interrupt agent. Interrupt table 630, as shown in FIG. 6, contains segment numbers 635 which point to corresponding segment numbers 645 in a segment table 640. For example, the first segment number "0006" of interrupt table 630 points to segment number "0006" of segment table 640. Each segment number 645 of segment table 640 corresponds to a particular scene stored on the media delivery device. The video agent at the direction of the interrupt agent retrieves the video segment corresponding to the referenced segment and outputs it to the video buffer.

Referring again to FIG. 1, the processor of client node 100 executes one or more sequences of one or more instructions contained in the memory. Such instructions may be read into the memory from a computer-readable medium via input/output device 102. Execution of the sequences of instructions contained in the memory causes the processor to perform the process steps described herein. In an alternative implementation, hard-wired circuitry may be used in place of or in combination with software instructions to implement the invention. Thus implementations of the invention are not limited to any specific combination of hardware circuitry and software.

The term "computer-readable medium" as used herein refers to any media that participates in providing instructions to the processor of client node 100 for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire, and fiber optics. Transmission media can also take the form of acoustic or light waves, such as those generated during radio-wave and infra-red data communications.

Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, PROM, and EPROM, a FLASH-EPROM, any other memory chip or cartridge, a carrier wave as described hereinafter, or any other medium from which a computer can read. Network signals carrying digital data, and possibly program code, to and from client node 100 are exemplary forms of carrier waves transporting the information. In accordance with the present invention, program code received by client node 100 may be executed by the processor as it is received, and/or stored in memory, or other non-volatile storage for later execution.

It will be apparent to those skilled in the art that various modifications and variations can be made in the interactive audiovisual simulation system and method of the present invention and in construction of this system without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A system for providing an interactive simulated dialogue over a network, comprising:

a client node connected to the network comprising a browser for selecting a simulated dialogue program, a network connection for receiving over the network a vocabulary set corresponding to the selected simulation program, a client agent for recognizing a meaning of a user voice input, and for transmitting over the network signals corresponding to the recognized meaning, a client buffer agent for receiving over the network signals representative of a meaningful response to the recognized meaning, and an output component for outputting an audiovisual representation of a human being speaking the meaningful response; and a server coupled to the network comprising a database containing vocabulary sets, wherein each vocabulary set corresponds to a simulated dialogue program, a server launch agent for receiving over the network the selection of the simulated dialogue program and for transmitting over the network the vocabulary set corresponding to the selected dialogue program, a server agent for receiving signals over the network corresponding to the recognized meaning and for determining a meaningful response to the recognized meaning, and a server buffer agent for transmitting over the network signals representative of the meaningful response.

2. The computer network of claim 1, wherein the server enables a plurality of client nodes for a single simulated dialogue program.

3. A system for providing an interactive simulated dialogue over a network, comprising:

a client node connected to the network comprising means for selecting a simulated dialogue program, means for receiving over the network a vocabulary set corresponding to the selected simulation program, means for receiving user voice input, means for recognizing a meaning of the received user voice input, means for transmitting over the network signals corresponding to the recognized meaning, means for receiving over the network signals representative of a meaningful response to the recognized meaning, and means for outputting an audiovisual representation of a human being speaking the meaningful response; and a server coupled to the network comprising a database containing vocabulary sets, wherein each vocabulary set corresponds to a simulated dialogue program, means for receiving over the network an identification of the selection of the simulated dialogue program, means for transmitting over the network the vocabulary set corresponding to the selected simulated dialogue program, means for receiving over the network signals corresponding to the recognized meaning, means for determining a meaningful response to the recognized meaning, and means for transmitting over the network signals representative of the meaningful response.

4. A client node for connecting to a computer network including a server to provide an interactive simulated dialogue, comprising:

a client launch agent for determining a system capacity of the client node and for installing a simulated dialogue program based on the determination of the system capacity;

an input device receiving user voice input;

a client agent recognition engine for determining the meaning of the user voice input;

a network connection receiving a simulated dialogue program from the server and transmitting over the network signals corresponding to the determined meaning;

a client buffer agent receiving over the network signals representative of a meaningful response to the user voice input; and an output component for outputting an audiovisual representation of a human being speaking the meaningful response.

5. The client node of claim 4, wherein the client launch agent determines compatibility of a speech application engine with the simulated dialogue program.

6. The client node of claim 5, wherein the client launch agent receives a compatible speech application engine from the server based on a compatibility determination, and installs the compatible speech application engine at the client node.

7. A client node for connecting to a computer network including a server to provide an interactive simulated dialogue, comprising:

means for determining a system capacity of the client node;

means for receiving a simulated dialogue program over the network;

means for installing the simulated dialogue program based on the determination of the system capacity;

means for receiving user voice input;

means for determining the meaning of the user voice input;

means for transmitting over the network signals corresponding to the meaning of the user voice input;

means for receiving over the network signals representative of a meaningful response to the transmitted signals; and means for outputting an audiovisual representation of a human being speaking the meaningful response.

8. A server coupled to a computer network including a client node for providing an interactive simulated dialogue, comprising:

a connection receiving over the network signals representative of a meaning of a user voice input and transmitting over the network signals representative of a meaningful response;

a server agent for determining the meaningful response to the received signals and for selecting a plurality of subsequent responses related to the meaningful response; and a buffer agent initiating a transfer of video signals corresponding to the subsequent responses to the client node, wherein said signals representative of the meaningful response comprise an audiovisual representation of a human being speaking the meaningful response.

9. The sever of claim 8, wherein the buffer agent determines network capacity for transfer of video signals corresponding to the subsequent responses, and transfers portions of video signals of each of the plurality of subsequent responses on a rotation basis based on a determination of the network capacity.

10. A server coupled to a computer network including a client node for providing an interactive simulated dialogue, comprising:

means for receiving over the network signals representative of a meaning of a user voice input;

means for determining a meaningful response to the received signals;

means for transmitting over the network signals representative of the meaningful response;

means for selecting a plurality of subsequent responses related to the transmitted meaningful response; and means for initiating a transfer of video signals corresponding to the subsequent responses to the client node in the background, wherein said signals representative of the meaningful response comprise an audiovisual representation of a human being speaking the meaningful response.

11. A computer-readable medium having stored thereon a computer program for an interactive simulated dialogue, the computer program causing a computer to perform the steps of:

determining a system capacity of the computer;

receiving simulated dialogue program from a server;

installing the simulated dialogue program based on the determination of the system capacity;

receiving user voice input;

recognizing a meaning of the user voice input;

transmitting to the server signals corresponding to the recognized meaning;

receiving from the server signals representative of a meaningful response to the recognized meaning; and outputting an audiovisual representation of a human being speaking the meaningful response.

12. A computer-readable medium having stored thereon a computer program for an interactive simulated dialogue, the computer program causing a computer to perform the steps of:

receiving from a client node signals representative of a recognized meaning of a user voice input;

determining a meaningful response to the recognized meaning of the user voice input;

transmitting to the client node signals representative of the meaningful response;

selecting a plurality of subsequent responses related to the transmitted meaningful response; and initiating a transfer of video signals corresponding to the subsequent responses to the client node in the background, wherein said signals representative of the meaningful response comprise an audiovisual representation of a human being speaking the meaningful response.

13. A method of providing an interactive simulated dialogue over a computer network, including a client node and a server, the method comprising:

receiving at the client node a signal representing a selection of a simulated dialogue program;

transmitting, by the server to the client node, a vocabulary set corresponding to the selected simulated dialogue program;

receiving at the client node user voice input;

recognizing a meaning of the user voice input;

transmitting, by the client node to the server, signals corresponding to the recognized meaning;

determining at the server a meaningful response to the recognized meaning;

transmitting, by the server to the client node, signals representative of the meaningful response; and outputting at the client node an audiovisual representation of a human being speaking the meaningful response.

14. The method of claim 13, further comprising the step of enabling participation from a plurality of client nodes for a single simulated dialogue program.

15. A method of providing an interactive simulated dialogue over a computer network, including a client node and a server, the method performed by the client node comprising:

determining a system capacity of the client node;

receiving a simulated dialogue program from the server;

installing the simulated dialogue program based on the determination of the system capacity;

receiving user voice input;

determining a meaning of the user voice input;

transmitting to the server signals corresponding to the determined meaning;

receiving from the server signals representative of a meaningful response to the determined meaning; and outputting an audiovisual representation of a human being speaking the meaningful response.

16. The method of claim 15, further comprising the step of determining compatibility of a speech application engine with the simulated dialogue program.

17. The method of claim 15, further comprising the steps of receiving a compatible speech application engine from the server based on a compatibility determination, and installing the compatible speech application engine at the client node.

18. A method of providing an interactive simulated dialogue over a computer network, including a client node and a server, the method performed by the server comprising:

receiving from the client node signals representative of a meaning of a user voice input;

determining a meaningful response to the user voice input;

transmitting to the client node signals representative of the meaningful response;

selecting a plurality of subsequent responses related to the transmitted meaningful response; and initiating a transfer of video signals corresponding to the subsequent responses to the client node in the background, wherein said signals representative of the meaningful response comprise an audiovisual representation of a human being speaking the meaningful response.

19. The method of claim 18, wherein the initiating step comprises:

determining network capacity for transfer of video signals corresponding to the subsequent responses; and transferring portions of video signals of each of the plurality of subsequent responses on a rotation basis based on a determination of the network capacity.

20. A computer-readable medium having stored thereon a computer program for an interactive simulated dialogue, the computer program causing a computer to perform the steps of:

receiving user voice input;

recognizing a meaning of the user voice input;

transmitting to the server signals corresponding to the recognized meaning;

receiving from the server signals representative of a meaningful response to the recognized meaning; and outputting an audiovisual representation of a human being speaking the meaningful response.

* * * * *